US006176449B1

(12) United States Patent
Cramer

(10) Patent No.: US 6,176,449 B1
(45) **Date of Patent: *Jan. 23, 2001**

(54) PROCESS AND DEVICE FOR WINDING PARTIAL WEBS INTO PARTIAL WEB ROLLS

(75) Inventor: Dirk Cramer, Duisberg (DE)

(73) Assignee: Voith Sulzer Papiertechnik Patent GmbH, Heidenheim (DE)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/232,826

(22) Filed: Jan. 19, 1999

(30) Foreign Application Priority Data

Jan. 20, 1998 (DE) ..... 198 01 874

(51) Int. Cl.[7] ..... B65H 35/06; B65H 19/12; B65H 19/20

(52) U.S. Cl. ..... 242/527.3; 242/530.4; 242/542.3; 242/542.4

(58) Field of Search ..... 242/527.3, 527.1, 242/530.4, 530, 541.1, 542.3, 542.4

(56) References Cited

U.S. PATENT DOCUMENTS

| | | | | |
|---|---|---|---|---|
| 3,157,371 | * | 11/1964 | Billingsley | 242/530 |
| 3,869,095 | * | 3/1975 | Diltz | 242/542.4 X |
| 4,487,377 | * | 12/1984 | Perini | 242/542.4 X |
| 4,572,451 | * | 2/1986 | Ikeda et al. | 242/527.3 |
| 4,767,075 | * | 8/1988 | Peters et al. | 242/527.3 X |
| 4,951,900 | * | 8/1990 | Goerner | 242/530.4 X |
| 4,988,052 | * | 1/1991 | Urban | 242/542.3 X |
| 5,308,006 | * | 5/1994 | Hehner | 242/530 X |
| 5,520,352 | * | 5/1996 | Prix et al. | 242/527.3 |
| 5,713,534 | * | 2/1998 | McClenathan et al. | 242/527.1 |
| 6,029,927 | * | 2/2000 | Wohlfahrt et al. | 242/527.2 |

FOREIGN PATENT DOCUMENTS

| | | | | |
|---|---|---|---|---|
| 341100 | * | 10/1959 | (CH) | 242/527.3 |
| 8317214 | | 9/1984 | (DE) . | |
| 3308271 | | 5/1988 | (DE) . | |
| 243748 | | 11/1987 | (EP) . | |
| 2136403 | | 9/1984 | (GB) . | |
| 60-82557 | * | 5/1985 | (JP) | 242/527.1 |
| 60-2554 | | 8/1985 | (JP) . | |
| 1668264 | * | 8/1991 | (SU) | 242/527.3 |
| 91/18814 | | 12/1991 | (WO) . | |

* cited by examiner

*Primary Examiner*—Donald P. Walsh
*Assistant Examiner*—Collin A. Webb
(74) *Attorney, Agent, or Firm*—Greenblum & Bernstein P.L.C.

(57) ABSTRACT

Method and a device for winding web sections into web section rolls. The device for winding web sections into web section rolls comprises a central roll and a cutting section. The web section rolls rest against the central roll in at least two winding position groups that are axially offset from one another at different positions about the circumference of the central roll. The cutting device axially extends axially over the winding position groups, and is adapted for pivoting about the central roll through the winding position groups. The method of winding web sections into web section rolls comprises cutting a web section at the point where a web section roll contacts the central roll and transferring the cut web sections to new roll cores.

35 Claims, 2 Drawing Sheets

PROCESS AND DEVICE FOR WINDING PARTIAL WEBS INTO PARTIAL WEB ROLLS

CROSS-REFERENCE TO RELATED APPLICATIONS

The present application claims priority under 35 U.S.C. § 119 of German Patent Application No. 198 01 874.6, filed on Jan. 20, 1998, the disclosure of which is expressly incorporated by reference herein in its entirety.

BACKGROUND OF THE INVENTION

1. Field of the Invention

The invention relates to a method and device for winding web sections into web section rolls, and more particularly, to a method and device for winding web sections into web section rolls which rest against a central roll in a number of winding position groups axially offset from one another in different circumferential positions. When the web section rolls reach a selected diameter, the web sections are cut and transferred to new roll cores.

2. Discussion of Background Information

Paper webs today are frequently produced on paper making machines where working width is greater than the width desired by the users in printing facilities and the like. In one of the last manufacturing steps, paper webs must be cut to the desired width and then rolled or wound. At least two or more separate web rolls are produced. Two different methods are known for winding these web section rolls. On the one hand, all of the web section rolls can be wound axially next to one another in a common winding bed constituted by two or more support rollers. This winding therefore takes place according to what is known as the "support roller" method.

A second method is the "backing roller" method, in which the individual separate web rolls are secured to a respective roll core. To adjust the winding tightness, which is determined by the pressure during winding, the web section rolls rest against a rider roll. If this rider roll is used jointly for all separate web rolls, it is also called a central roll.

When the separate web rolls are secured on their end faces, a certain spacing of the separate web rolls in the axial direction is required. Therefore, a number of winding position groups are provided, generally two, which are disposed against the central roll in different angular positions. The separate web rolls of different winding position groups are staggered relative to one another.

The "backing roll" method has proven to be useful. Nevertheless, problems may arise when the individual separate web rolls have reached their selected diameter, and it becomes necessary to transfer the web sections from the completely wound separate web rolls over to new roll cores. This situation occurs often, primarily when the cut material web comes from a jumbo roll or master roll, which has a significantly greater web length of the material web than the web length of the web sections on the separate web rolls. The path from the cutting location at which the web sections are cut, to the individual winding positions is of different lengths, thereby causing potential problems. Therefore, the individual web sections must be separately manipulated many times, a procedure that is complicated and cumbersome. In one situation, the web sections are cut so that a first winding position group is created. The separate web rolls in the first winding position group must then be slowly wound until the remaining web sections have reached a second winding position group (and others). Only then can the winding process continue as usual. Alternatively, all of the web sections are moved until they arrive in the last winding position group (generally the second group) and then the web sections associated with the first winding position group must be correspondingly cut.

SUMMARY OF THE INVENTION

Accordingly, the present invention is directed to a method and device for winding web sections into web section rolls that substantially obviates one or more of the problems arising from the limitations and disadvantages of the related art.

The device for winding web sections into web section rolls comprises a central roll having a circumference and an outer surface. The web section rolls rest against the central roll in at least two winding position groups. These winding position groups are axially offset from one another at different positions about the circumference of the central roll. The device also comprises a cutting device extending axially over the winding position groups, the cutting device being adapted for pivoting about the central roll through the winding position groups.

Additionally, another aspect of the device may comprise a securing device for securing a web section to the outer surface of the central roll. The cutting device of the invention may also be operable in two cutting directions. Alternatively, the invention may implement a combined cutting and securing device.

According to another feature of the invention, the central roll has a respective securing region adjacent to each winding position group (i.e., each winding position group comes into contact with a respective securing region), in which a securing force acts on each respective securing region. The securing region may also be adapted to be acted on with negative pressure by a securing device which generates a vacuum. Furthermore, the securing region may be acted on with negative pressure during winding and/or be disposed before one of the winding position groups with respect to the direction of rotation of the central roller.

Another aspect of the invention is directed to a method for winding web sections into web section rolls, comprising cutting a web section at the point where a web section roll contacts the central roll. When the web section roll reaches a selected diameter (e.g., when the web section is either too big or too heavy to handle), the cut web sections are transferred to new roll cores.

Furthermore, the method may comprise successively cutting the web sections of respective winding position groups (i.e., the web sections are cut in order to arrangement relative to the central roll and are not cut simultaneously).

Additionally, the method may further comprise using a single cutting device for cutting the web sections of all the winding groups, by moving the cutting device about the circumference of the central roll.

The method may also comprise affixing a new initial portion of each web section to the central roll, moving the cutting device into a starting position and affixing the new initial portion of each web section to a roll core.

Moreover, the method may further comprise suctioning the new initial portion of a web section against the central roll.

Also, the method may further comprise using the cutting device to transport the new initial portion of a web section.

The method may yet additionally comprise feeding the new initial portion of each web section into a last winding position group, affixing a predetermined number of web sections to the last winding position group, pivoting the cutting device to a first winding position group, and cutting the web sections not associated with the last winding position group in separate winding positions.

The method may still further comprise suctioning the web section against the surface of the central roll, and interrupting web tension upstream from a first winding position group with respect to the direction of rotation of the central roller.

Another method for winding web sections into web section rolls comprises moving a cutting device from a first position to a second position, when each roll reaches a selected diameter, cutting, with the cutting device, a first web section at a first winding group, removably affixing the first web section to the central roll, moving the cutting device from the second position to a third position, cutting, with the cutting device, a second web section at a second winding group, removably affixing the second web section to the central roll, moving the cutting device from the third position back to the first position, and transferring the cut web sections to respective new roll cores.

Further, the method may also comprise suctionally affixing the first web section to the central roll, and suctionally affixing the second web section to the central roll.

Still another method for winding web sections into web section rolls comprises removably affixing a first web section and a second web section against the central roll, removably clamping a cutting device over the first and second web sections and removably securing the first and second web sections to the central roll. The cutting device is then rotated along with the central roll to a second winding position group, and the first and second web sections are suctionally affixed to the central roll. The second web section is then transferred to a new second roll core, and the cutting device is unclamped from the first and second web sections. After that, the first and second web sections are released from the central roll, the cutting device is rotated to a first winding position group while the first and second web sections are cut, and the first web section is transferred to a new first roll core.

Other exemplary aspects and features of the present invention may be ascertained by reviewing the present disclosure and the accompanying drawings.

BRIEF DESCRIPTION OF THE DRAWINGS

The present invention is further described in the detailed description which follows, in reference to the noted plurality of drawings by way of non-limiting examples of preferred embodiments of the present invention, in which like numerals represent like elements throughout the several views of the drawings, and wherein.

DETAILED DESCRIPTION OF THE PRESENT INVENTION

Figure 1:
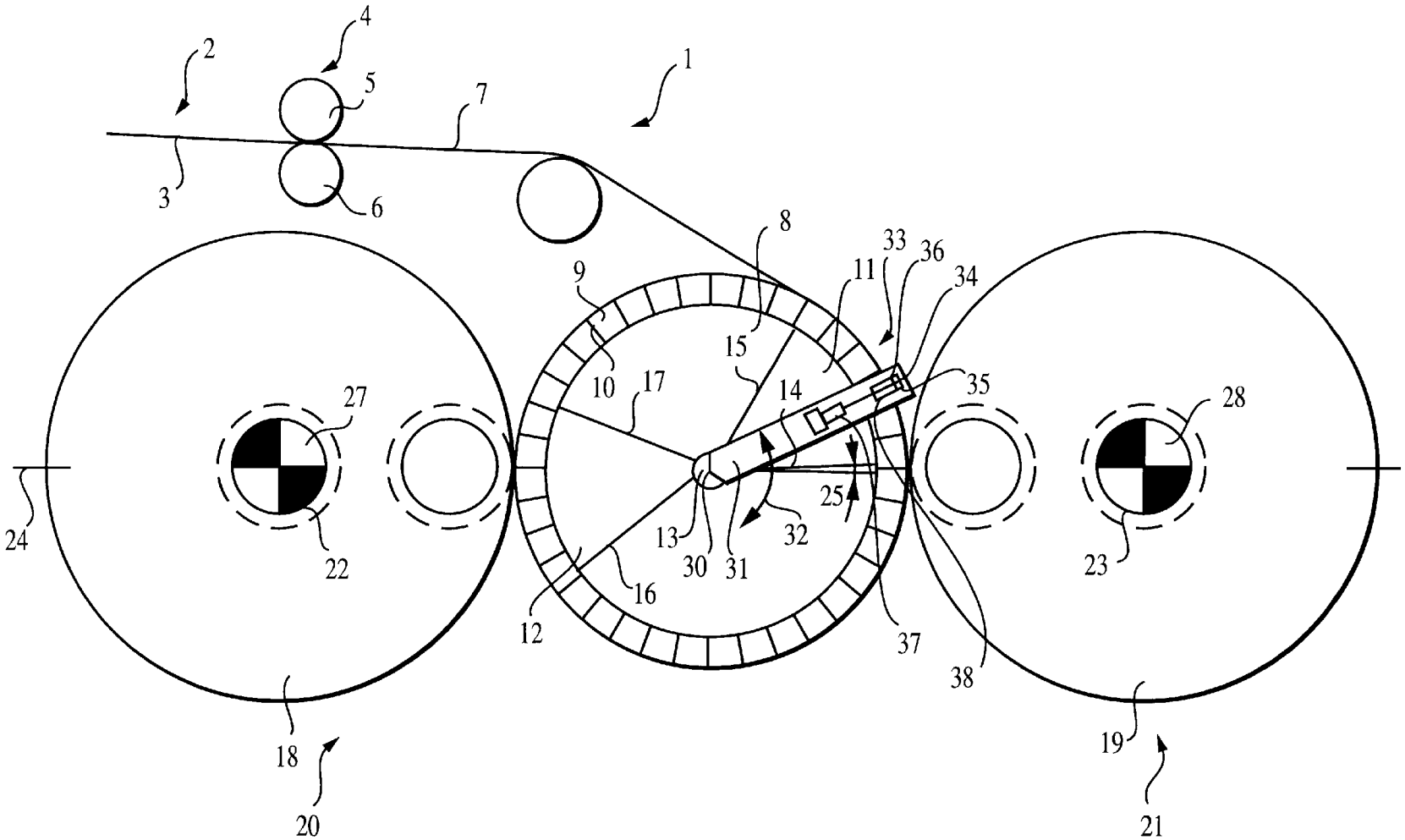
FIG. 1 is a schematic side view of a device for winding web sections into web section rolls.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

The material web described below with respect to the present invention is identified as a paper web for illustrative purposes only. It is readily apparent to those skilled in the art that other material webs can be used with the invention in alternative embodiments, including but not limited to webs made of cardboard, metal foils, or plastic foils.

The present invention simplifies roll changes when winding web sections in different winding position groups, by cutting web sections in the region at which web section rolls contact a central roll.

The method and device for winding web sections into web section rolls assures that the web sections always end at the locus where the new roll core is intended to be placed. Guiding the individual new initial partial webs of the web sections around the central roll again to transfer them to a roll core is, therefore, unnecessary. By cutting web sections in the region in which the web section rolls contact the central roll, the web sections will have the correct length. The changing of web section rolls is thus simplified.

The web sections of different winding position groups are successively cut (i.e., the web sections are cut in order of arrangement relative to the central roll and are not cut simultaneously). The web sections in one winding position group may be cut, without concern that malfunctions will occur in web sections of other winding position groups.

The same cutting device that is conveyed around the central roll may be used for all of the cuts. The web section rolls in the individual winding position groups can be cut in succession. Since the cutting device is pivoted about the central roll, all of the winding positions may be reached and the web sections of the winding position groups may be successively cut (i.e., the web sections are cut in order of arrangement relative to the central roll are not cut simultaneously).

The new initial partial webs of the web sections are secured against the central roll and the cutting device is brought back into a starting position before the new initial partial webs are attached to the roll cores. This procedure ensures that the same starting conditions exist for every cutting procedure. Thus, the cutting device always cuts the web sections precisely at the location where the web sections have been released from the central roll, so that the web sections may be wound onto the web section rolls. The cutting device is kept radially outside the web sections resting on the central roll.

It is preferable that the new initial partial webs are suctioned against the central roll, so that the movement of the cutting device is unhindered. The suction constitutes a gentle securing process so that even sensitive material webs can be handled.

The cutting device may also be used to transport new initial partial web sections. This process is useful when the web sections are not cut from an endless material web, but are cut, for example, from a jumbo roll or master roll. A jumbo roll or master roll has an end and must occasionally be changed.

Often new initial partial web sections must be wound about the central roll to the last winding position group. In such a situation, the new initial partial web sections can be secured to the central roll by the cutting device, which pivots along with the central roll into the last winding position group.

At the beginning of winding the web sections, all of the new initial partial web sections are fed into the last winding position group. Only the web sections to be wound in this last winding position group are affixed there, and the cutting device is pivoted back to the first winding position group and cuts the portions of the web sections not intended to be affixed to the first winding position group.

The new initial partial webs of all of the web sections are grasped with the cutting device and fed into the last winding position group. However, not all of the new initial partial web sections are grasped there, but only the new initial partial webs of those web sections that are also intended to be wound in this last winding position group. The new initial partial webs can be secured to their respective corresponding winding cores. The new initial partial webs of the rest of the web sections are released from the last winding position group. The new initial partial web sections can, therefore, be detached from the central roll and, vertically dangle under the effect of gravity.

If more than two winding position groups are used, then the web sections which belong to a middle winding position group (i.e., the winding position groups disposed intermediate the first winding position group and the last winding position group), remain secured at this group. On the path back to the starting position, the cutting device can then cut all of the web sections in the region of their winding position groups and thus can automatically bring them to the correct length.

Web tension may be interrupted upstream of the first winding position group, by suctioning the web sections against the surface of the central roll. A frictional connection may thus be produced between the web sections and the central roll. This frictional connection makes it possible to exert the tension required for the longitudinal cutting of the web sections. Downstream of the location in which the web sections are suctioned against the surface of the central roll, the web sections are virtually without tension. The winding tension can then be adjusted by a mechanical drive of the individual web section rolls. The winding tension is thus uncoupled from the tension required for cutting the web sections.

Often, smooth papers (e.g., coated papers) are problematic when wound at maximum winding speed. With increasing speed, the negative influence of incoming air that adheres to the material web increases. If the web sections are suctioned against the surface of the central roll, the incoming air is immediately removed, i.e., the web sections are prevented from "floating" and are consequently prevented from shifting in the lateral direction. The web sections are then fixed to the roll surface.

The invention also relates to a winding device for winding the web sections into web section rolls. The web section rolls rest against a common central roll in at least two winding position groups axially offset from one another in different circumferential positions. A cutting device that extends axially over the winding positions can be pivoted around the central roll through all winding position groups.

The cutting device cuts the web section rolls at the individual winding position groups, i.e., in the location (i.e., nip) where the web section rolls rest against the central roll. Once cut by the cutting device, all web sections rest against the central roll, thus permitting the new initial partial web sections to be immediately placed onto a new roll core, thereby allowing winding to continue.

The cutting device may also be combined with a securing device that enables at least one web section to be fixed to the surface of the central roll. At the beginning of a winding process in which all of the new initial partial web sections have the same length, the cutting device grasps the desired web section beginning(s) and guides (them) around the central roll to the associated winding position group. Other securing devices are not required, thereby eliminating the possibility of the securing device and the cutting device colliding with each other.

The cutting device may also work in both directions about the circumference of the central roll. When transferring the web sections from a full web section roll to a new roll core, one cutting device is sufficient, which is aligned parallel to the direction with which the web sections travel around the central roll. The web sections are cut by the cutting device at the point where they leave the central roll, i.e., at the transition from being supported on the central roll to being supported on the web section rolls.

At the beginning of a winding process, guiding all of the new initial partial web sections to the last winding position group by holding them with the cutting device is advantageous. Only the new initial partial web sections associated with this winding position group are fixed there, and the other new initial partial web sections dangle vertically under the force of gravity. When the cutting device is moved backwards, it functions in the other cutting direction and can also cut the web sections in their respective individual winding position groups.

At each winding position group, the central roll has a securing region that can be acted on with a securing force (e.g., suction). This securing region is used to secure the new initial partial web sections until the individual roll cores are brought into position and the new initial partial web sections have been attached to their respective new roll cores. Once the new initial partial web sections are secured, then the cutting device can be moved back into its starting position.

The securing regions can be acted upon with suctional force such as a vacuum. This feature eliminates the need for a separate device for acting on the securing regions, which may otherwise interfere with the operation of the cutting device.

A first securing region that is acted on with a vacuum during winding is disposed before the first winding position group with respect to the direction of rotation of the central roller. With the aid of this first securing region, which can also be used to "thread" the corresponding web sections, the tension in the web may be easily interrupted. Since the vacuum is present even during winding, a frictional force is created between the surface of the central roll and the web sections, thereby enabling longitudinal cutting of the web sections. Furthermore, the air adhering to the web sections is removed by suction, which prevents the webs from floating and shifting in a lateral direction.

Referring to the drawing wherein like numerals represent like elements, a device for winding web sections into web section rolls 1 has a feed section 2 into which is fed a material web 3, for example, a paper web wound off of a jumbo or master roll. The material web 3 then runs through a cutting section 4, where it is divided into web sections 7 through a known process, for example, cutting blades 5 and 6. The cutting blades 5, 6 cut the material web 3 in the longitudinal direction. A certain tensile force is required for this purpose. This tensile force is applied via a central roll 8 that is designed as a suction roll.

The central roll 8 has a roll sleeve 9 that is shown with exaggerated thickness for reasons of clarity. Arranged in roll sleeve 9 are many through bores or through holes 10, which pass through roll sleeve 9. Arranged in the interior of the roll sleeve 9 are a first suction chamber 11 and a second suction chamber 12, which are supplied with negative pressure via a securing mechanism such as a vacuum connection 13. In other words, air is continuously sucked out of the suction chambers 11, 12.

The two suction chambers 11, 12 each extend in the circumferential direction only over a certain portion of the central roll 8. Thus, the suction chamber 11 has two delimiting walls 14, 15 in the circumferential direction. The suction chamber 12 has delimiting walls 16, 17. All delimiting walls 14–17 are sealed at the inner circumference of the roll sleeve 9 by a sealing device (not shown).

Both suction chambers 11, 12 extend over angular regions on the order of, for example, approximately 60°. This angle is not imperative, however. Larger or smaller angles may be chosen in alternative embodiments as long as it is ensured, particularly for suction chamber 11, that the suction pressure in suction chamber 11, together with the surface of central roll 8 (which is determined by the angle), are adequate to suctionally press the web sections 7 against the surface of central roll 8 strongly enough that the friction produced thereby suffices to transmit the tensile force necessary for cutting.

The web sections 7 are then wound up into web section rolls 18, 19. Web section rolls 18, 19 of adjacent web sections are arranged here in different winding position groups 20, 21. In each winding position group 20, 21, the individual web sections 18, 19 have a certain axial distance from one another, but can otherwise have the same or nearly the same winding axis. The web section rolls 18, 19 of the two winding position groups 20, 21 are staggered relative to one another.

While the web sections 7, which are being wound onto the web section roll 19, wrap around the central roll 8 by approximately 60°, the web sections 7 that are being wound onto the web section roll 18 are guided around the central roll 8 by approximately 240°.

The web section rolls 18, 19 are wound onto roll cores 22, 23 respectively, which are driven, for example, via closable clamping spindles, which in turn have their own mechanical drive 27, 28. These drives are schematically indicated in the figure.

The roll cores (with drive) are depicted in a position in which the web section rolls 18, 19 have already reached a certain circumference. The roll cores (without drive) are sketched in phantom lines, in a position in which the winding of web section rolls 18, 19 is just beginning (without the drive for the purpose of distinguishing them).

Furthermore, for reasons of clarity, it is assumed for the present exemplary embodiment that the center points or rotational axes of central roll 8 and roll cores 22, 23, and thus of web section rolls 18, 19, are arranged on a horizontal plane 24. The center points of roll cores 22, 23 move horizontally in this plane 24 during winding. Accordingly, the point of contact between web section rolls 18, 19 (or, at the start of winding, between roll cores 22, 23) is also located on this plane 24. These points are then also the loci where the web sections leave the central roll 8.

The suction chamber 11 ends in the circumferential direction before this plane 24, i.e., the lower delimiting wall 14 creates an angle 25 with plane 24. The angle however, is generally small (e.g., from 1° to 10°). This angle ensures that the negative pressure in suction chamber 11 can no longer act on the web section when it is supposed to be lifted from central roll 8 in order to be wound onto web section roll 19. The vacuum section that is formed by suction chamber 11 thus ends before the locus where web sections 7 are lifted from central roll 8.

In contrast, suction chamber 12 may extend beyond the locus where the web sections 7 are lifted that are to be wound onto the web section rolls 18. This is because the suction chamber 12 serves to hold against the central roll 8 the web sections to be wound onto the web section rolls 18 until they reach the roll core or cores 22, to which they are adhered during set-up.

Suction chamber 11 may also be used for this purpose. For example, the negative pressure in suction chamber 11 may be set to various levels. During operation, e.g. during winding, the adjustment must be high enough for the friction between the web sections 7 and central roll 8 to suffice to apply the tensile stress necessary for slitting. This is not necessary during set-up. During set up, the adjustment need only be sufficient to guide the leaders of the web sections to roll cores 23. The suction chamber 11 ends before the appropriate contact locus, but this is not important because web sections 7 are supplied from above this location. Therefore, after leaving the suction section web sections 7 hang down freely and are guided to their roll cores 23 with the aid of gravity.

Once winding begins, the negative pressure may be increased, i.e., the absolute pressure in the suction chamber 11 is reduced, in order to generate the appropriate friction.

The central roll 8 has an axis 30 around which a support 31 is affixed to the two axial end faces of the central roll by a pair of mounting legs. The support 31 can also be pivoted in the direction of double arrow 32. The support 31 protrudes slightly beyond the diameter of the central roll 8. A cutting device 33 is disposed on the distal end thereof, and has a narrow blade 34 that is drawn taut in the axial direction (i.e., along the length of the central roll 8) between the two mounting legs. Due to the axial tension, the blade has a relatively high stability. It has a cutting edge 35, 36 on each of its edges so that the blade 34 can cut in two directions.

Figure 2:
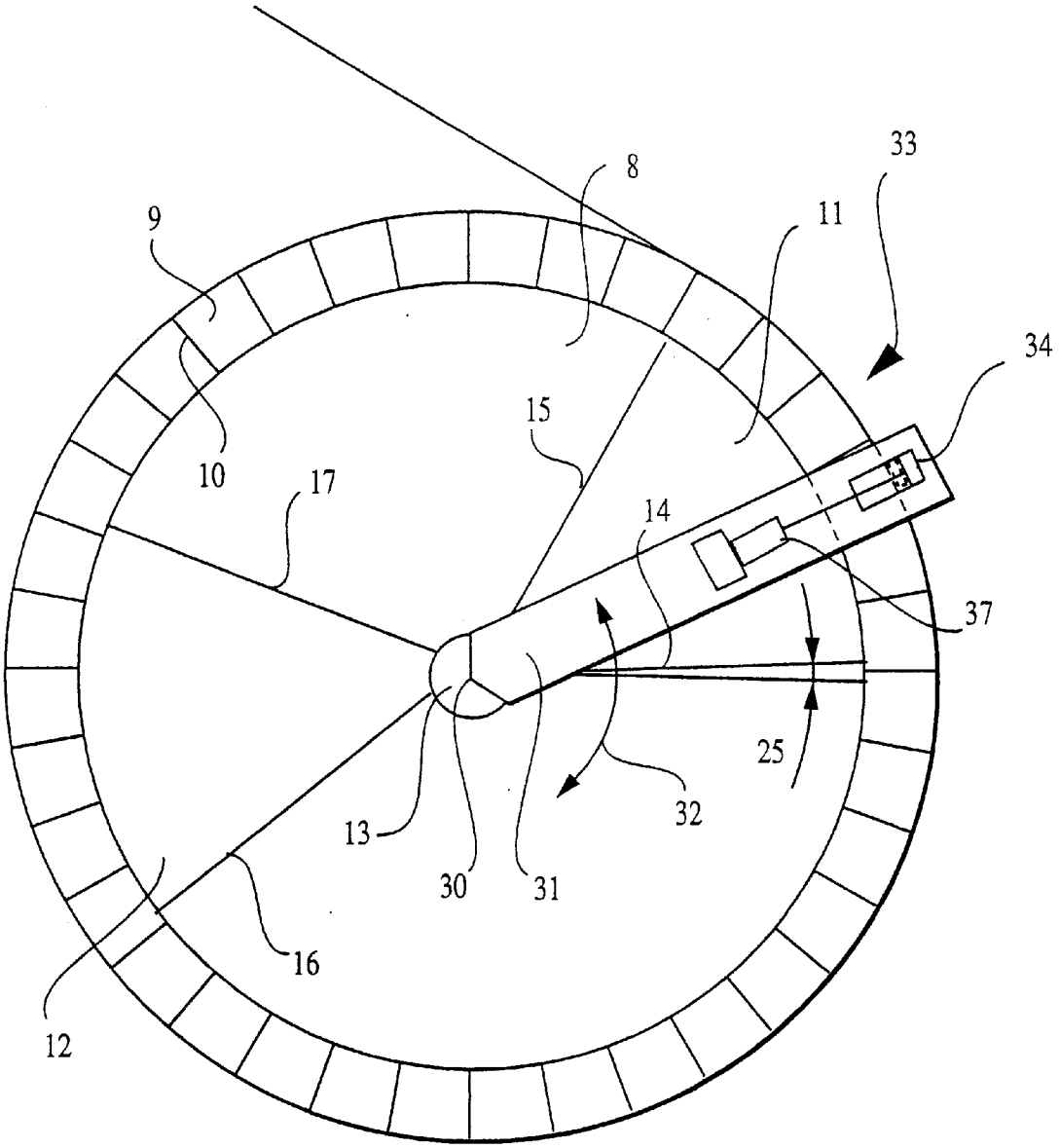
FIG. 2 is an enlarged view of FIG. 1 showing the radial movement of the blade of the present invention.

The blade 34 can be moved in the radial direction through the action of a schematically represented drive 37, for example a pneumatic or hydraulic piston-cylinder arrangement shown in FIG. 2. Phantom lines show the blade 34 securing the web section 7 to the central roll. This movement of the blade 34 is made possible by means of a likewise schematically represented lengthwise support channel 38 for the blade 34 in the support 31.

Two different operational processes can be easily controlled with the aid of the cutting device 33.

In the first operational process, it is assumed that in the two winding position groups 20, 21, web section rolls 18, 19 have been wound to the point that their selected diameter has be reached (e.g., when the web section is either too big or too heavy to handle). The winding is then interrupted. The cutting device 33 moves in the clockwise direction around the central roll 8 from the starting position depicted. In so doing, it first cuts through the web sections that are wound in the winding position group 21. Since negative pressure in the suction chamber 11 is maintained, the corresponding web sections remain fixed to the central roll 8.

The cutting device 33 is pivoted further around the central roll 8 in a clockwise direction (relative to the Fig.) and then, after pivoting slightly more than 180°, also cuts through the web sections that are wound in the winding position group 20. Since the suction chamber 12 is also acted on with negative pressure, the new initial partial web sections remain fixed to the surface of the central roll 8 after the cutting. The cutting device 33 can then be moved back into the starting position, as depicted in the Fig. New roll cores that can be provided, for example, with a self-adhesive surface, are moved onto the new initial partial web sections and the new initial partial web sections are then attached to respective new roll cores. The vacuum in the suction chamber 12 can be switched off. The negative pressure in the suction chamber 11 can be brought to a value that is sufficient for interrupting the web tension. After this process, the winding of the web section rolls 18, 19 can begin again. The roll change takes place relatively quickly because it is no longer necessary to longitudinally adjust the individual web sections to the various distances between the cutting section 4 and the individual winding position groups 20, 21.

This operating process applies when a number of web section rolls 18, 19 are wound from a near endless material web 3 or a material web 3 with a significantly greater length than is wound onto the web section rolls 18, 19.

If a new material web 3 is used, for example when a new jumbo or master roll is used, the operating process is somewhat different.

In the second operating process, all of the web sections 7 are placed against the central roll 8 and are secured with the aid of the suction chamber 11. The cutting device is positioned over the beginning of all of the web sections so that the blade 34 can be lowered onto the web sections with the aid of the drive 37. The web sections are thus clamped firmly against the surface of the central roll 8. The cutting device 33 then rotates together with the central roll 8 in a clockwise direction until all of the new initial partial web sections have come to the winding position group 20. At winding position group 20, the vacuum in the suction chamber 12 is activated so that all of the new initial partial web sections are secured to the central roll at this position.

The roll cores 22 for the web section rolls 18 that are to be wound in the winding position group 20 are then attached to the corresponding new initial partial web sections. The blade 34 is temporarily released (i.e., slightly distally displaced) from the web sections and is slightly moved back counterclockwise. The vacuum in the suction chamber 12 is then switched off, and the new initial partial web sections of those web sections that are not intended to be wound at winding position group 20 are released. These new initial partial web sections then fall downward under the effect of gravity, i.e., they slip out of the gap between the blade 34 and the central roll 8. In the present embodiment, these web sections hang vertically downward in the region of the nip of the winding position group 21. If the cutting device 33 is moved back counterclockwise, it cuts through the downward hanging web sections 7 in this region. This cut is performed by the second cutting edge 36. If necessary, the web sections may then be drawn taut.

In order to improve the cutting process, the blade 34 may be moved back and forth slightly in the axial direction during the pivoting motion. An improvement of the cutting is also achieved if the cutting edges 35, 36 are serrated.

The blade 34 is thin enough to be guided though the nip between the web section rolls 18, 19 and the central roll 8. If the blade width in the circumference direction is small enough, then it is unnecessary to provide the blade 34 with a curvature to conform to the curvature of the central roll 8. Since a thin band that can be tensioned is used as the blade 34, this band may flex when passing through the respective nips of the winding position groups 20, 21.

If more than the two winding position groups 20, 21 are provided, for example, an additional winding position group below the central roll 8, then the cutting device 33 that is traveling counterclockwise cuts through the web sections, which are wound in this winding position group (not shown), and cuts them to the correct length. In this connection, either an additional suction chamber must be provided for these winding position groups or other means must be used in order to secure the web sections which are intended to be wound in this additional winding position group.

It is noted that the foregoing examples have been provided merely for the purpose of explanation and are in no way to be construed as limiting of the present invention. While the present invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A method for winding web sections into web section rolls, the web section rolls resting against a central roll having a circumference and an outer surface, the web section rolls contacting the central roll in at least two winding position groups, the at least two winding position groups axially offset from one another at different positions about the circumference of the central roll, comprising:

cutting, with a cutting device, a web section when the web section roll reaches a selected diameter;

securing the web section to the central roll by radially moving the cutting device toward the central roll;

transporting a new initial portion of a web section, using the cutting device; and transferring the cut web sections to new roll cores.

2. The method for winding web sections into web section rolls according to claim 1, further comprising:

cutting the web sections of a first said winding position group; and cutting the web sections of a second said winding position group.

3. The method for winding web sections into web section rolls according to claim 2, further comprising using a single cutting device for cutting the web sections of all the winding groups, by moving the cutting device about the circumference of the central roll.

4. The method for winding web sections into web section rolls according to claim 3, further comprising:

affixing a new initial portion of each web section to the central roll;

moving the cutting device into a starting position; and affixing the new initial portion of each web section to a roll core.

5. The method for winding web sections into web section rolls according to claim 4, further comprising suctioning the new initial portion of a web section against the central roll.

6. The method for winding web sections into web section rolls according to claim 3, further comprising:

feeding the new initial portion of each web section into a last winding position group;

affixing at least one web section to the last winding position group;

pivoting the cutting device to a first winding position group; and cutting the web sections not associated with the last winding position group, in respective separate winding positions.

7. The method according to claim 1, wherein said cutting and transporting are performed simultaneously.

8. The method for winding web sections into web section rolls according to claim 1, further comprising:

suctioning the web section against the surface of the central roll; and interrupting web tension upstream from a first winding position group with respect to a direction of rotation of the central roller.

9. A method for winding web sections into web section rolls, the web section rolls resting against a rotatable central roll having a circumference and an outer surface, the web section rolls contacting the central roll in at least two winding position groups, the at least two winding position groups axially offset from one another at different positions about the circumference of the central roll, comprising:

removably affixing a first web section and a second web section against the central roll;

removably clamping a cutting and securing device over the first and second web sections by radially moving the cutting and securing device in a direction toward the central roll;

removably securing the first and second web sections to the central roll;

rotating the cutting and securing device along with the central roll to a second winding position group;

suctionally affixing the first and second web sections to the central roll;

transferring the second web section to a new second roll core;

unclamping the cutting and securing device from the first and second web sections;

releasing the first and second web sections from the central roll;

rotating the cutting and securing device to a first winding position group while cutting the first and second web sections; and transferring the first web section to a new first roll core.

10. A device for winding web sections into web section rolls, comprising:

a central roll having a circumference and an outer surface, the web section rolls resting against said central roll in at least two winding position groups, said at least two winding position groups axially offset from one another at different positions about said circumference of said central roll; and a combined cutting and securing device extending axially over said at least two winding position groups, said cutting and securing device adapted for pivoting about said central roll through said at least two winding position groups, and further adapted to removably secure a web section to said outer surface of said central roll by radially moving the cutting and securing device in a direction toward the central roll.

11. The device according to claim 10, wherein said cutting and securing device is further adapted to simultaneously pivot about said central roll while removably securing said web section to said outer surface of said central roll.

12. The device according to claim 10, wherein said cutting and securing device is operable in two cutting directions.

13. The device according to claim 10, wherein said central roll has a respective securing region adjacent to each of said at least two winding position groups, and further comprising a securing mechanism adapted to exert a securing force on each said respective securing region.

14. The device according to claim 13, wherein said securing mechanism is adjustable and is adapted to exert negative pressure on said securing region.

15. The device according to claim 14, wherein:

said securing mechanism is adapted to exert negative pressure on said securing region during winding and is disposed upstream one of said at least two winding position groups with respect to the direction of rotation of said central roller.

16. A device for winding web sections into web section rolls, comprising:

a central roll having a circumference and an outer surface, the web section rolls resting against said central roll in at least two winding position groups, said at least two winding position groups axially offset from one another at different positions about said circumference of said central roll, said central roll further having a respective securing region adjacent to each of said at least two winding position groups;

a securing mechanism adapted to exert a securing force on each said respective securing region; and a combined cutting and securing device extending axially over said at least two winding position groups, said cutting and securing device adapted for pivoting about said central roll through said at least two winding position groups, and further adapted to removably secure a web section to said outer surface of said central roll by radially moving the cutting and securing device in a direction toward the central roll.

17. The device according to claim 16, wherein said cutting and securing device is further adapted to simultaneously pivot about said central roll while removably securing said web section to said outer surface of said central roll.

18. The device according to claim 16, wherein said cutting and securing device is operable in two cutting directions.

19. The device according to claim 16, wherein said securing mechanism is adapted to exert negative pressure on said securing region during winding and is disposed upstream one of said at least two winding position groups with respect to the direction of rotation of said central roller.

20. A method for winding web sections into web section rolls, the web section rolls resting against a central roll having a circumference and an outer surface, the web section rolls contacting the central roll in at least two winding position groups, the at least two winding position groups axially offset from one another at different positions about the circumference of the central roll, comprising:

cutting, with a cutting edge of a cutting blade, a web section when the web section roll reaches a selected diameter;

transporting a new initial portion of a web section, using a width portion of the cutting blade; and transferring the cut web sections to new roll cores.

21. The method for winding web sections into web section rolls according to claim 20, further comprising:

cutting the web sections of a first said winding position group; and cutting the web sections of a second said winding position group.

22. The method for winding web sections into web section rolls according to claim 21, further comprising using a single cutting blade for cutting the web sections of all the winding groups, by moving the cutting blade about the circumference of the central roll.

23. The method for winding web sections into web section rolls according to claim 22, further comprising:

affixing a new initial portion of each web section to the central roll;

moving the cutting blade into a starting position; and affixing the new initial portion of each web section to a roll core.

24. The method for winding web sections into web section rolls according to claim 23, further comprising suctioning the new initial portion of a web section against the central roll.

25. The method for winding web sections into web section rolls according to claim 22, further comprising:

feeding the new initial portion of each web section into a last winding position group;

affixing at least one web section to the last winding position group;

pivoting the cutting blade to a first winding position group; and cutting the web sections not associated with the last winding position group, in respective separate winding positions.

26. The method for winding web sections into web section rolls according to claim 20, further comprising:

suctioning the web section against the surface of the central roll; and interrupting web tension upstream from a first winding position group with respect to a direction of rotation of the central roller.

27. A method for winding web sections into web section rolls, the web section rolls resting against a rotatable central roll having a circumference and an outer surface, the web section rolls contacting the central roll in at least two winding position groups, the at least two winding position groups axially offset from one another at different positions about the circumference of the central roll, comprising:

removably affixing a first web section and a second web section against the central roll;

removably clamping a width portion of a cutting and securing blade over the first and second web sections and removably securing the first and second web sections to the central roll;

rotating the cutting and securing blade along with the central roll to a second winding position group;

suctionally affixing the first and second web sections to the central roll;

transferring the second web section to a new second roll core;

unclamping the cutting and securing device from the first and second web sections;

releasing the first and second web sections from the central roll;

rotating the cutting blade to a first winding position group while cutting the first and second web sections; and transferring the first web section to a new first roll core.

28. A device for winding web sections into web section rolls, comprising:

a central roll having a circumference and an outer surface, the web section rolls resting against said central roll in at least two winding position groups, said at least two winding position groups axially offset from one another at different positions about said circumference of said central roll; and a cutting and securing blade extending axially over said at least two winding position groups and having a cutting edge and a width portion, said cutting and securing blade adapted for pivoting about said central roll through said at least two winding position groups, and further adapted to removably secure a web section to said outer surface of said central roll with said width portion.

29. The device according to claim 28, wherein said cutting and securing blade is operable in two cutting directions.

30. The device according to claim 28, wherein said central roll has a respective securing region adjacent to each of said at least two winding position groups, and further comprising a securing mechanism adapted to exert a securing force on each said respective securing region.

31. The device according to claim 30, wherein said securing mechanism is adjustable and is adapted to exert negative pressure on said securing region.

32. The device according to claim 31, wherein:

said securing mechanism is adapted to exert negative pressure on said securing region during winding and is disposed upstream one of said at least two winding position groups with respect to the direction of rotation of said central roller.

33. A device for winding web sections into web section rolls, comprising:

a central roll having a circumference and an outer surface, the web section rolls resting against said central roll in at least two winding position groups, said at least two winding position groups axially offset from one another at different positions about said circumference of said central roll, said central roll further having a respective securing region adjacent to each of said at least two winding position groups;

a securing mechanism adapted to exert a securing force on each said respective securing region; and a cutting and securing blade extending axially over said at least two winding position groups and having a cutting edge and a width portion, said cutting and securing blade adapted for pivoting about said central roll through said at least two winding position groups, and further adapted to removably secure a web section to said outer surface of said central roll with said width portion.

34. The device according to claim 33, wherein said cutting and securing blade is operable in two cutting directions.

35. The device according to claim 33, wherein said securing mechanism is adapted to exert negative pressure on said securing region during winding and is disposed upstream one of said at least two winding position groups with respect to the direction of rotation of said central roller.

* * * * *